US011085267B2

(12) United States Patent
Saraya et al.

(10) Patent No.: US 11,085,267 B2
(45) Date of Patent: Aug. 10, 2021

(54) METHODS AND SYSTEMS FOR FRAC PLUGS WITH PUMP DOWN RINGS

(71) Applicant: Vertice Oil Tools, Missouri City, TX (US)

(72) Inventors: Mohamed Ibrahim Saraya, Sugar Land, TX (US); Stephen Parks, Houston, TX (US); Mike Los, Houston, TX (US); Alex Goodwin, Houston, TX (US)

(73) Assignee: Vertice Oil Tools Inc

( * ) Notice: Subject to any disclaimer, the term of this patent is extended or adjusted under 35 U.S.C. 154(b) by 66 days.

(21) Appl. No.: 16/528,831

(22) Filed: Aug. 1, 2019

(65) Prior Publication Data

US 2021/0032953 A1 Feb. 4, 2021

(51) Int. Cl.

| | |
|---|---|
| ***E21B 33/12*** | (2006.01) |
| ***E21B 23/06*** | (2006.01) |
| ***E21B 34/06*** | (2006.01) |

(52) U.S. Cl.

CPC ..... *E21B 33/1208* (2013.01); *E21B 23/06* (2013.01); *E21B 34/063* (2013.01)

(58) Field of Classification Search

CPC ..... E21B 33/1208; E21B 34/063

See application file for complete search history.

(56) References Cited

U.S. PATENT DOCUMENTS

| | | | | |
|---|---|---|---|---|
| 7,806,189 | B2 * | 10/2010 | Frazier | E21B 33/1204 166/376 |
| 8,127,832 | B1 * | 3/2012 | Bond | E21B 43/25 166/63 |
| 9,163,479 | B2 * | 10/2015 | Rogers | E21B 34/066 |
| 2008/0271883 | A1 * | 11/2008 | Barton | E21B 34/063 166/332.8 |
| 2009/0188664 | A1 * | 7/2009 | Smith, Jr. | E21B 33/16 166/70 |
| 2015/0247372 | A1 * | 9/2015 | Angeles Boza | E21B 23/10 166/297 |
| 2015/0361746 | A1 * | 12/2015 | Mansell | E21B 21/12 166/373 |
| 2016/0069155 | A1 * | 3/2016 | Todd | E21B 34/063 166/292 |
| 2019/0003266 | A1 * | 1/2019 | Zhou | E21B 43/119 |
| 2019/0186228 | A1 * | 6/2019 | Beckett | E21B 47/117 |
| 2019/0264534 | A1 * | 8/2019 | Gordon | E21B 34/063 |

OTHER PUBLICATIONS

"Zonal Isolation" Definition Available from: https://www.pvisoftware.com/drilling-glossary/zonal-isolation.html (Year: 2020).*

* cited by examiner

*Primary Examiner* — Blake E Michener
*Assistant Examiner* — Theodore N Yao
(74) *Attorney, Agent, or Firm* — Pierson IP, PLLC

(57) ABSTRACT

A Frac plug with multiple pump down rings, wherein the outer diameter of the pump down rings is smaller than that of the inner diameter of the casing, which may not allow a seal to be formed across the casing. Systems may also include a rupture disc within the Frac plug that is positioned adjacent to an atmospheric chamber, which allows the rupture disc to be removed based on a known pressure.

10 Claims, 2 Drawing Sheets

METHODS AND SYSTEMS FOR FRAC PLUGS WITH PUMP DOWN RINGS

BACKGROUND INFORMATION

Field of the Disclosure

Examples of the present disclosure relate to a double pump down ring and temporary seal within a wellbore. More specifically, embodiments include a multi pump down ring that is configured to create enough flow turbulence and friction to allow a tool to be pushed downhole without forming a seal across the inner diameter of the casing.

Background

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Conventionally, after cementing a well and to achieve Frac/zonal isolation in a Frac operation, a frac plug and perforations on a wireline are pushed downhole to a desired a depth. Then, a frac plug is set and perforation guns are fired above to create conduit to frac fluid. This enables the fracing fluid to be pumped. Typically, to aid in allowing the assembly of perforation and frac plug to reach the desired depth, specifically in horizontal or deviated laterals, pumping operation can be used. During the pumping operation the wireline is pumped down hole with the aid of flowing fluid. However, since the Frac plug and the bottom hole assembly are smaller than casing internal diameter, there will be substantial fluid pumping efficiency lost due to bypass. Currently, the industry relies on pump down darts to be mounted on the plug front. This design is prone to failure due to seal failure of dart flipping and disconnecting from the bottom.

Further, in conventional methods, a ball is dropped to isolate the frac plug's internal diameter to initiate fractures in a newly perforated casing above the isolated inner diameter. This requires pumping the ball to the desired depth, consuming scarce frac fluid. Alternatively having a ball on a seat while running the Frac Plug creates other operational challenges. For example, if a preformation gun misfires, the operator ends up with a cased hole. This requires milling out the frac plug to be able to pump anything in the well, i.e.: the ball on the seat of the Frac Plug and unperforated casing creates a closed system.

Accordingly, needs exist for systems and methods utilizing a Frac plug with multiple pump down rings, wherein the outer diameter of the pump down rings is smaller than that of the inner diameter of the casing, which may not allow a seal to be formed across the casing. Further needs exist for systems and methods with a rupture disc within a Frac plug that may create a weak point in the plug. The rupture disc is positioned adjacent to an atmospheric chamber with a static pressure, which allows the rupture disc to be removed based on a known pressure differential.

SUMMARY

Embodiments disclosed herein describe systems and methods for a Frac plug with a plurality of pull-down rings and a rupture disc that is positioned adjacent to an atmospheric chamber.

The pull-down rings may be positioned on an outer diameter of the Frac plug, and be configured to increase the outer diameter of the Frac plug. The pull-down rings may have an outer diameter that is less than an inner diameter of casing, which may not allow the pull-down rings to pass inside the casing. The pull-down rings may be configured to receive a force from fluid to pull the Frac plug downhole. Additionally, the pull-down rings may also aid in creating turbulence around the Frac plug bottom, creating a higher pressure drop in front of the Frac plug that aids in pushing the Frac plug at faster speeds. Each of the pull-down ring may be configured to create friction by interacting with fluid flowing downhole, which may allow the Frac plug to be pulled downhole at faster speeds.

A weak point assembly may be configured to be positioned within a flapper or on the side of the mandrel. The weak point assembly may include a rupture disc, one way seal, and atmospheric chamber.

The rupture disc may be a weak point that is configured to break, dissolve, shear, rupture, etc. responsive to a pressure differential across the rupture disc. For example, the rupture disc may be configured to rupture responsive to a pressure differential across the rupture disc being greater than 5000 PSI. A proximal end of the rupture disc may be exposed to the inner diameter of the casing above the Frac plug when set, and a distal end of the rupture disc may be exposed to the atmospheric chamber. In other embodiments, the rupture disc may be an integral part of the flapper.

The one way seal may be configured to form a seal across an end of the weak point assembly and may be exposed to the inner diameter of the casing below the Frac plug when set, and not allow communication between the atmospheric chamber and the inner diameter of the casing below the Frac plug. However, the one way seal may be configured to break, be removed, etc. responsive to fluid flowing through the weak point assembly in a direction from a proximal end of the wellbore towards a distal end of the wellbore. In other embodiments, the one was seal may be integral part of the flapper The atmospheric chamber may be a chamber, cavity, compartment, positioned between the one way seal and the distal end of the rupture disc. The atmospheric chamber may be configured to have a preset and static pressure, and may not be in communication with elements outside of the weak point assembly. As such, the atmospheric chamber may have a constant, known pressure within the chamber.

In embodiments, because the atmospheric chamber has a known and preset pressure, the amount of pressure on the proximal end of the rupture disc required to rupture the rupture disc is also known. As such, the pressure in the inner diameter of the casing below the weak point assembly is not a factor determining when the rupture disc will rupture.

Responsive to the rupture disc rupturing, the rupture disc and the one way seal may be removed from the weak point assembly, and a passageway may be created through the weak point assembly.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
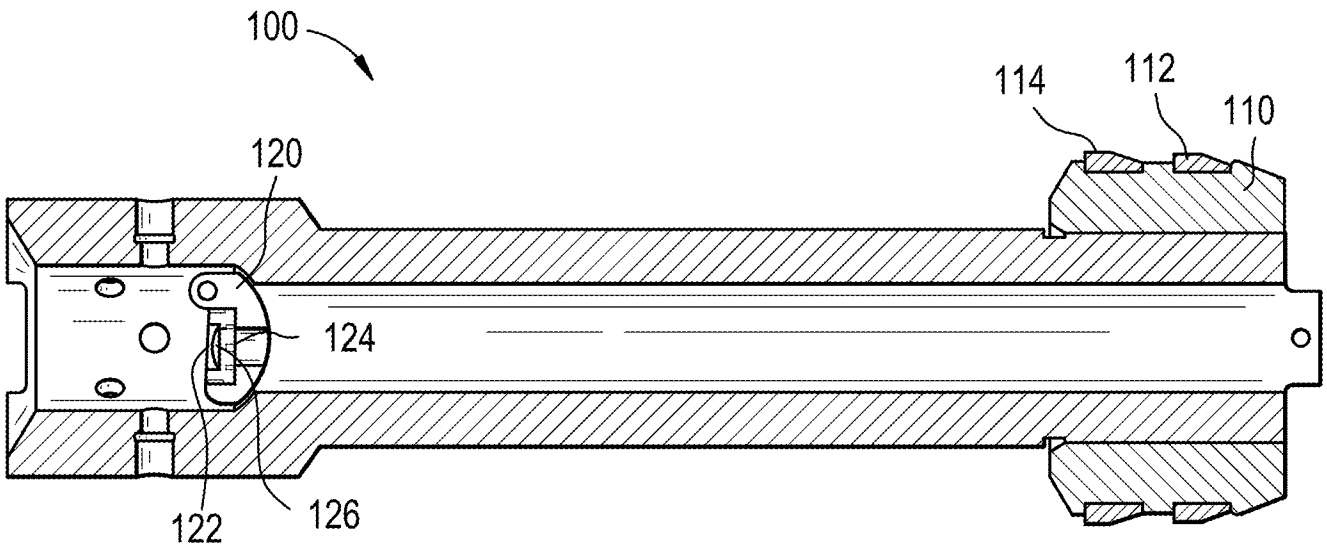
FIG. 1 depicts a system with multiple pump down rings with a weak point assembly, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a downhole tool 100, according to an embodiment. Downhole tool 100 may include a pull-down element 110 and weak point assembly 120.

Pull-down element 110 may be positioned on a distal end of tool 100, while in other embodiments the pull-down element 110 may be positioned on a proximal end of the tool 100, the pull-down element may be configured to assist in pulling down tool 100 through casing. Pull-down tool 110 may include a first pull-down ring 112 and a second pull-down ring 114. In other embodiments, pull-down tool 110 may include any number of pull-down rings 112, wherein a number of pull-down rings associated with tool 100 may be based on a length of tool 100 and a depth of the casing.

Pull-down rings 112, 114 may be projections positioned on an outer diameter of pull-down element 110, and may be configured to increase the outer diameter of pull-down element 110. An outer diameter of pull-down rings 112, 114 may be greater than that of tool 100 but less than an inner diameter of the casing. As such, pull-down rings 112, 114 may be configured to receive a force from fluid to pull the pull-down element 110 downhole. Further, each of the pull-down rings 112, 114 may be configured to create friction by interacting with fluid flowing downhole, which may allow pull-down element 110 to be pulled downhole.

Weak point assembly 120 may be configured to be positioned within a flapper, in other embodiments, weak point assembly 120 may be any geometric shape that can be inserted inside the frac plug or be connected to it. The flapper may be configured to have an open and closed positioned responsive to flowing fluid from a distal end of tool 100 towards a proximal end of tool 100 while the weak point assembly 120 is intact. Weak point assembly 120 may include a rupture disc 122, one way seal 124, and atmospheric chamber 126. In another embodiment, the rupture disc 122, one-way seal 124, and atmospheric chamber 126 may be positioned on a Frac plug mandrel. Further, in other embodiments, the rupture disc 122 and one way seal 124 may be a weak point, for simplicity, the word rupture disc and/or one way seal in this document may refer to either design.

Rupture disc 122 may be configured to break, dissolve, shear, rupture, etc. responsive to a pressure differential across the rupture disc 122 being greater than a rupture threshold. Alternatively, rupture disc 122 may be a weak point configured to break responsive to the pressure differential being crater than the rupture threshold. For example, rupture disc 122 may be configured to rupture or break responsive to a pressure differential across rupture disc 122 being greater than 5000 PSI. A proximal end of rupture disc 122 may be exposed to the inner diameter of the casing above the rupture disc 122, and a distal end of rupture disc 122 may be exposed to atmospheric chamber 126.

One way seal 124 may be configured to form a seal across an end of weak point assembly 120, and not allow communication between atmospheric chamber 126 and the inner diameter of the casing below weak point assembly 120. However, one way seal 124 may be configured to break, be removed, etc. responsive to fluid flowing through the weak point assembly 120 in a direction from a proximal end of the wellbore towards a distal end of the wellbore. This may occur after rupture disc 122 has ruptured.

Atmospheric chamber 126 may be a chamber, cavity, compartment, positioned between the one way seal and the distal end of the rupture disc. The atmospheric chamber may be configured to have a preset pressure, and may not be in communication with elements outside of the weak point assembly.

In embodiments, because atmospheric chamber 126 has a known preset pressure, the amount of pressure on the proximal end of the rupture disc 122 required to rupture the rupture disc 122 is also known. As such, the pressure in the inner diameter of the casing below weak point assembly 120 is not a factor determining when rupture disc 122 may rupture due to the relative positioning of atmospheric chamber 126 and rupture disc 122.

Responsive to rupture disc 122 rupturing, the rupture disc 122 and one way seal 124 may be removed from weak point assembly 120, and a passageway may be created through weak point assembly 120.

Figure 2:
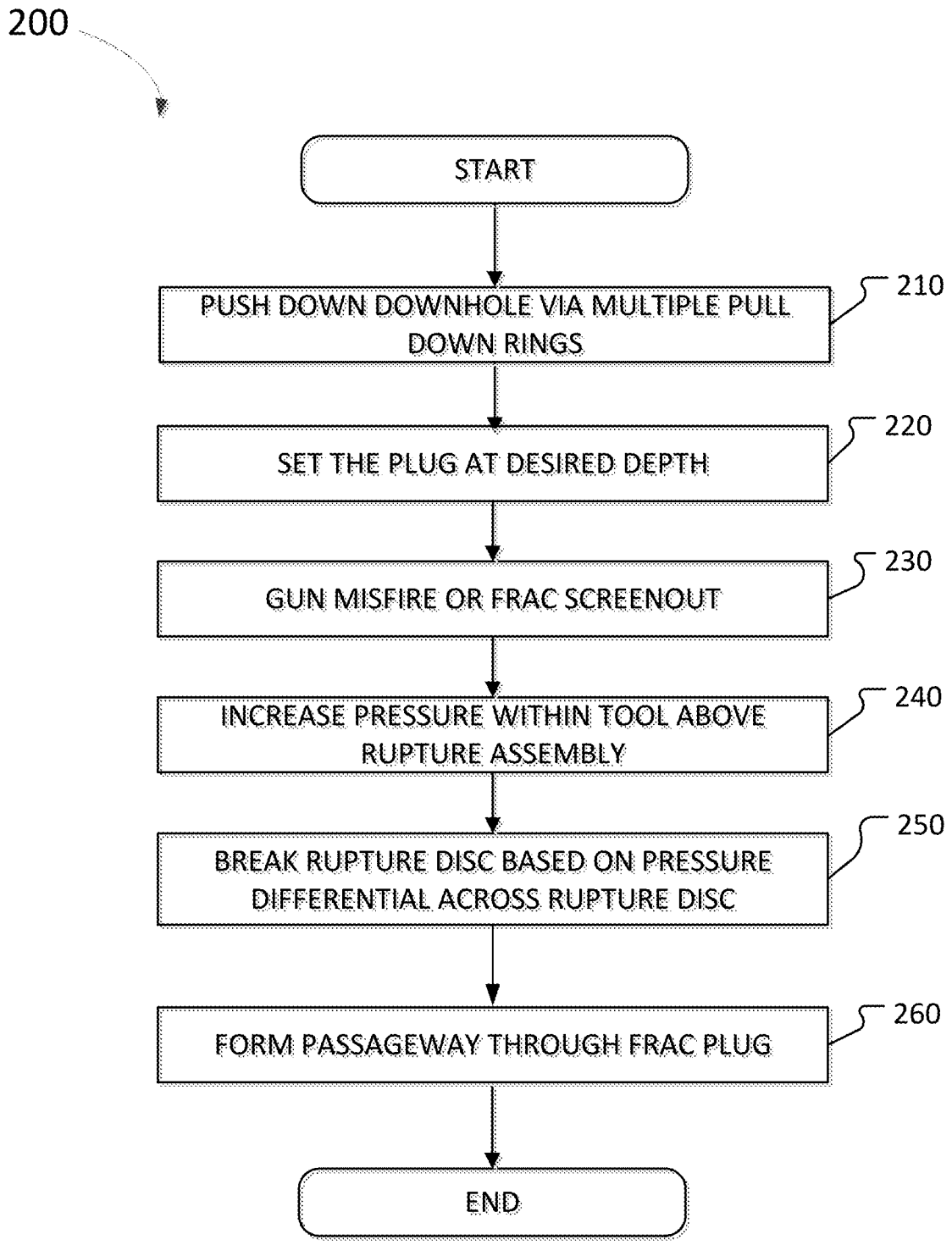
FIG. 2 depicts a method for utilizing a downhole tool, according to an embodiment.

FIG. 2 depict an operation sequence for utilizing a Frac plug, according to an embodiment. The operations of operational sequence presented below are intended to be illustrative. In some embodiments, operational sequence may be accomplished with one or more additional operations not described, and/or without one or more of the operations discussed. Additionally, the order in which the operations of operational sequence are illustrated in FIG. 2 and described below is not intended to be limiting.

At operation 210, a tool may be pushed downhole by flowing fluid between an outer diameter of the tool and casing. The fluid flowing downhole may be configured to interact with multiple pull-down rings that have a larger outer diameter than that of the tool but smaller than that of the inner diameter of the casing. The flowing fluid may create friction and a pressure drop with the multiple pull-down rings to move the tool downhole without creating a weak point in a wireline because a seal cannot be formed across the inner diameter of the casing due to the multiple pull-down rings having a smaller diameter than that of the casing.

At operation 220, the frac plug may be set at a desired depth downhole.

At operation 230, a perforation gun may misfire, a frac operation screen out, or any other procedure that creates a sudden and significant restriction to communication within the wellbore above the frac plug.

At operation 230, a pressure within the tool above a weak point assembly may be increased.

At operation 240, responsive to the pressure within the tool above the weak point assembly being increased past a rupture threshold, a rupture disc may break. In embodiments, the rupture threshold may be associated with a pressure differential required to rupture the rupture disc. Because the rupture disc is positioned adjacent to a sealed atmospheric chamber with a preset and static pressure, the amount of pressure to increase above the rupture disc to cross the rupture threshold is also known.

At operation 250, the rupture disc and a one way seal that was configured to seal the atmospheric chamber may travel downhole creating a passageway through the flapper.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A method for utilizing a frac plug including:

positioning a weak point assembly across a central axis of the frac plug, the weak point including a rupture disc and an atmospheric chamber;

running in hole the frac plug on wireline while the weak point is positioned across the central axis of the frac plug;

setting the frac plug at a desired depth across a casing using the wireline;

performing a fracturing procedure above the frac plug while the frac plug is at the desired depth, wherein the fracturing procedure includes a perforation gun misfire;

increasing a pressure within the frac plug to a first pressure based on the performing the fracturing procedure;

breaking the rupture disc based on a pressure differential across the rupture disc, wherein the pressure differential is based on the first pressure associated with the fracturing procedure applied to the proximal end of the weak point assembly and a second pressure of the atmospheric chamber.

2. The method of claim 1, wherein the atmospheric chamber has a static pressure.

3. The method of claim 2, wherein the static pressure within the atmospheric chamber does not change while the rupture disc is intact.

4. The method of claim 1, further comprising:

isolating a distal end of the atmospheric chamber from the inner diameter of the casing.

5. The method of claim 4, further comprising:

isolating, via the rupture disc, a proximal end of the atmospheric chamber from the inner diameter of the casing.

6. The method of claim 1, further comprising:

forming a passageway through a weak point when the rupture disc breaks.

7. The method of claim 1, further comprising:

pumping fluid downhole in a space between an outer diameter of multiple pull down rings and casing to create flow turbulence and friction to pump down the wireline conveyed frac plug based on the turbulence and the friction against the multiple pull down rings.

8. The method of claim 7, wherein none of the multiple pull-down rings extend across an inner diameter of the casing to form a seal against the inner diameter of the casing.

9. A method for utilizing a frac plug including:

positioning a weak point assembly across a central axis of the frac plug, the weak point including a rupture disc and an atmospheric chamber;

running in hole the frac plug on wireline while the weak point is positioned across the central axis of the frac plug;

setting the frac plug at a desired depth across a casing using the wireline;

performing a fracturing procedure above the frac plug while the frac plug is at the desired depth, wherein the fracturing procedure includes a frac operation screen out;

increasing a pressure within the frac plug to a first pressure based on the performing the fracturing procedure;

breaking the rupture disc based on a pressure differential across the rupture disc, wherein the pressure differential is based on the first pressure associated with the fracturing procedure applied to the proximal end of the weak point assembly and a second pressure of the atmospheric chamber.

10. A method for utilizing a frac plug after cementing a well including:

positioning a weak point assembly across a central axis of the frac plug, the weak point including a rupture disc and an atmospheric chamber;

running in hole the frac plug on wireline while the weak point is positioned across the central axis of the frac plug;

setting the frac plug at a desired depth across a casing cemented in the well using the wireline;

performing a fracturing procedure above the frac plug while the frac plug is at the desired depth, wherein the fracturing procedure is a fracturing operation that creates a restriction to communication within a wellbore above the frac plug, and the fracturing procedure occurs after cementing the casing;

increasing a pressure within the frac plug to a first pressure based on the performing the fracturing procedure;

breaking the rupture disc based on a pressure differential across the rupture disc, wherein the pressure differential is based on the first pressure associated with the fracturing procedure applied to the proximal end of the weak point assembly and a second pressure of the atmospheric chamber.

* * * * *